US005443001A

United States Patent [19]

Keller, III et al.

[11] Patent Number: 5,443,001

[45] Date of Patent: Aug. 22, 1995

[54] APPARATUS FOR IMPRINTING CONICALLY-SHAPED PLASTIC CUPS

[76] Inventors: C. Michael Keller, III; Pamela S. Keller, both of 49130 Turnpike Rd., Folsom, La. 70437; Christopher Greve, 70110 Highway 1077, Covington, La. 70433; Ronald O'Connor, 208 Jules, Jefferson, La. 70121

[21] Appl. No.: 955,664

[22] Filed: Oct. 2, 1992

[51] Int. Cl.[6] ..... B31F 1/07

[52] U.S. Cl. ..... 101/27; 101/9; 101/35

[58] Field of Search ..... 101/4, 9, 10, 11, 16, 101/21, 27, 28, 31, 35, DIG. 30; 156/233, 309.9, 540, DIG. 9, DIG. 21, DIG. 24

[56] References Cited

U.S. PATENT DOCUMENTS

| | | | |
|---|---|---|---|
| 1,406,538 | 2/1922 | Choate | 156/233 |
| 3,585,093 | 6/1971 | Britt | 156/234 |
| 3,634,174 | 1/1972 | Warsager | 156/540 |
| 3,657,053 | 4/1972 | Warsager | 156/540 |
| 3,657,054 | 4/1972 | Warsager | 156/542 |
| 3,718,517 | 2/1973 | Berg | 156/234 |
| 3,816,207 | 6/1974 | Robertson et al. | 156/238 |
| 4,023,482 | 5/1977 | Swett et al. | 101/21 |
| 4,175,993 | 11/1979 | Robertson | 156/234 |
| 4,343,670 | 8/1982 | Brown | 156/233 |
| 4,484,970 | 11/1984 | Burzlaff et al. | 156/233 |
| 4,628,810 | 12/1986 | Chan | 101/27 |
| 4,701,235 | 10/1987 | Mitsam | 156/233 |
| 4,806,197 | 2/1989 | Harvey | 156/449 |

*Primary Examiner*—Edgar S. Burr
*Assistant Examiner*—Ren Yan

[57] ABSTRACT

A method and apparatus for imprinting plastic frustroconically shaped container with a die containing a printing element or elements compresses and flattens the container sidewall during printing. The design is arcuately arranged to correct for distortion which would occur if the flattened side wall were printed with orthogonally arranged letters or design.

12 Claims, 4 Drawing Sheets

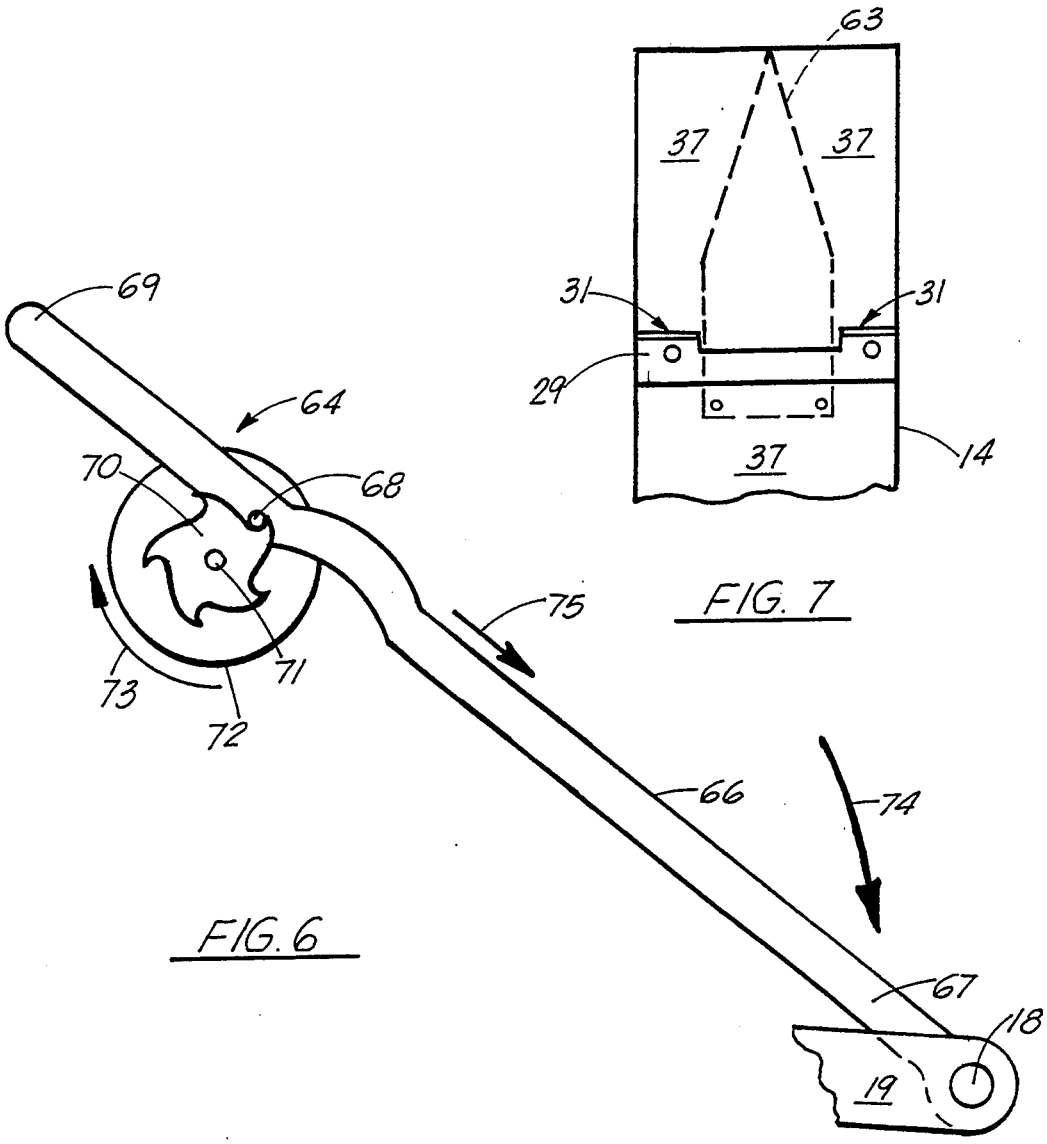
FIG. 7
FIG. 6
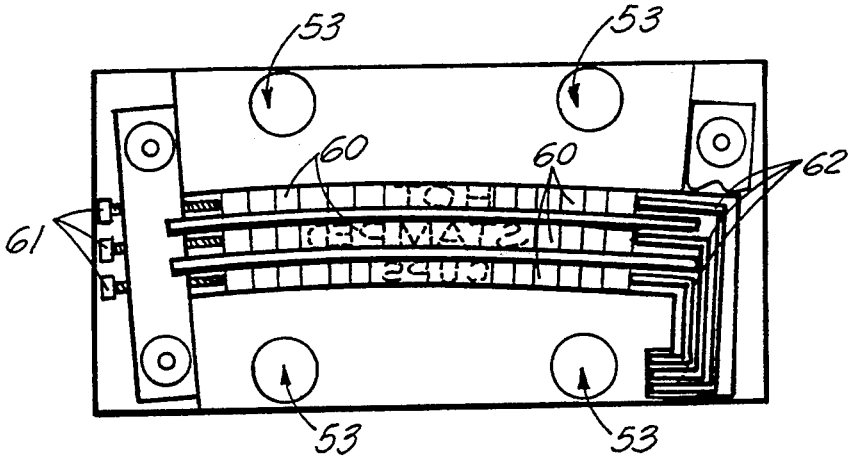
FIG. 8

APPARATUS FOR IMPRINTING CONICALLY-SHAPED PLASTIC CUPS

BACKGROUND OF THE INVENTION

1. Field Of The Invention

The present invention relates to a method and apparatus for hot stamping foil material to flexible plastic drinking cups and the like. Even more particularly, the present invention relates to an improved method and apparatus for hot stamping plastic cups with foil wound upon a roll wherein during printing, the cup side wall is flattened to receive printed material which is then properly proportioned once the cup is removed from the apparatus and returned to its original shape.

2. General Background

Plastic drinking cups are commercially available in various sizes such as for example eight ounce, twelve ounce, sixteen ounce, twenty-four ounce, thirty-two ounce, and the like. These plastic cups are sold at fast food restaurants and convenience stores for containing soft-drink products, distributed through super markets to end users, and supplied by novelty companies to clubs and organizations with desired printed material thereon. It is known to supply such plastic cups with multi-colored emblems.

A decorative material that is added to plastic cups can be a foil that is placed on the cup using a hot stamping process. As part of this process, the foil like material is contained on a long web wound upon a roll. However, in any attempt to print upon a frustro-conically shaped cup, distortion of the line of type or emblem would limit hand-printing by businesses such as gift shops and card shops. An example of applying foil using hot stamping is seen in U.S. Pat. No. 3,585,093, incorporated herein by reference.

Hand printing is done almost exclusively on flat surfaces. The curved "horseshoe" type die could possibly be used for hand printing on curved surfaces, but the amount of wrap around the circumference could be more limited than with our method due to a scuffing/-scraping action at the edges of the die. These dies are expensive also. Another limiting factor is the lack of appropriate supporting devices (mandrels) for existing machines.

Various devices have been patented which are directed to the concept of hot stamping various objects including molded plastic containers. U.S. Pat. No. 1,406,538 discloses roll leaf stamping for decorating book covers and leather goods. An example is U.S. Pat. No. 4,343,670 entitled "Apparatus and Process for Hot Stamping Containers". In the '670 patent, the container is moved past a heated die with a platen carrying a printing die, the die being floatably movable so that linear uniform pressure is exerted between a confronting container surface and die surface. As the container moves across the die surface, it is rotated so that the foil which is pinched between the container and die is transferred onto the surface of the rotatable container. The uniform linear pressure between container and die, transfers foil to the accompaniment of rotation of the container so that defect-free lamination of foil is transferred onto the container surface to form decorative or alphanumeric information. This process relies upon a "controlled force matrix". The operation is continuous, with successively spaced containers moving into printing position relatively to the die, where the hot stamping operation is repeated. Containers are automatically removed after printing, and successive containers supplied either manually or automatically. FIGS. 9 and 10 of the '670 patent show views of the container and mandrel under pressure to maintain linear contact.

The Warsager patent 3,634,174 entitled "Machine For Surface Decorating of Articles" relates to the transfer of a decorative foil from a carrier tape to an object using pressure and heat in which the object can be round or flat. The machine can be used for moving the object vertically into the die or the die can be moved vertically across the object. Another Warsager patent which relates to hot stamping is U.S. Pat. No. 3,657,053 entitled "Mechanism For Rigidifying A Collapsible Object".

The Robertson patent 4,175,993 relates to a method and apparatus for applying indicia to the surface of generally cylindrical articles such as bottles. The patent is entitled "Article Decorating Machine and Method". The machine disclosed in the '993 patent utilizes a rotary article transport assembly or turret mechanism which has a plurality of gripper hands mounted thereon for holding the cylindrical articles to be decorated. At least one article orienting station is provided to orient the article so that the indicia is applied over the proper portion of the surface of the article. After orienting, the article is rotated in a holding assembly and the indicia carrying tape or foil is pressed against the appropriate portion of the outer surface of the article by a heated die carried on a cylindrical drum mounted immediately adjacent to the article being decorated. Means are provided for rotating the article being decorated and the die carrying drum at the same peripheral surface speed. Also, means are provided for positively feeding the decorating tape between the bottle and the transfer die. Another patent that relates to embossing foil to a portion of a flexible web of material is the Mitsam patent 4,701,235 entitled "Method For Applying an Embossing Foil To A Flexible Material".

In the Britt patent 3,585,093 entitled "Method and apparatus For Applying Metal Foil", the metal foil is coated with an adhesive bonding agent for securing it to the surface of an article. The metal foil is pressed against the surface with the adhesive in contact with the surface while the foil is at ambient temperature, then causing the metal foil to adhere to the surface by the application of a heat pulse for a short period of time. Then the coated surface is allowed to cool while maintaining pressure thereon.

Another patent that relates to a hot stamping machine for transferring a decorative material to an article is seen in the Warsager patent 3,657,054 entitled "Decorating Machine For Transferring A Decorative Material to An Article".

The Harvey patent 4,806,197 relates to an apparatus for decorating the cylindrical surface of an article, such as a bottle with a label.

A method and apparatus for hot stamping cylindrical articles such as a hollow plastic bottle is disclosed in the Robertson patent 3,816,207.

The Berg patent 3,718,517 entitled "Method and Apparatus For Decorating Articles" relates to the decorating of the outer surface of an article or wear wherein the article is initially positioned on a holding mandrel mounted to a rotary table while at a loading station. The article is subsequently advanced to a decorating station where a layer of transfer material is interposed between the article and a printing die. The transfer material is caused to engage the article being decorated with the die being moved across the outer surface thereof whereby a portion of the transfer material is caused to adhere to the article.

None of these prior art patented systems uses an arcuate type, distorted for correction of a frustro-conical cup, and/or wherein the cup wall is flattened during printing. All require rigidifying the container.

SUMMARY OF THE PRESENT INVENTION:

The present invention provides an improved method and apparatus for imprinting flexible, frustro-conically shaped articles and using a continuous web of foil material. The transfer of material from the foil web onto the surface of the frustro-conically shaped article (such as a drinking cup) is achieved by the application of heat and pressure to the foil and the plastic article. The transfer can be in the form of printed material such as type written words, or an artistic design all of which is determined by the die effecting the transfer. A reverse image is used to form the type.

The method includes the step of supporting the article on an anvil. The article is then moved in relation to a printing head between a first loading position wherein the article is spaced from the printing head and a second printing position wherein the article abuts the printing head.

The article is deformed so that a flat surface is presented to a printing die when in the printing position. The article is then imprinted with a plurality of characters such as letters contained upon the die. The characters or letters track an arcuate path during printing on the flattened surface of the article. When the article returns to its original shape, the printed material is correctly oriented to a desired position. Thus, any printed matter on the die appears slightly distorted, arranged along an arcuate path, because the frustro-conically shaped article to be printed is flattened during the printing process.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein:

FIG. 6 is a fragmentary view of the preferred embodiment of the apparatus of the present invention;

FIG. 7 is a fragmentary view of the preferred embodiment of the apparatus of the present invention; and FIG. 8 is a fragmentary view of an alternate embodiment of the apparatus of the present invention.

DETAILED DESCRIPTION OF THE PREFERRED EMBODIMENT

Figure 1:
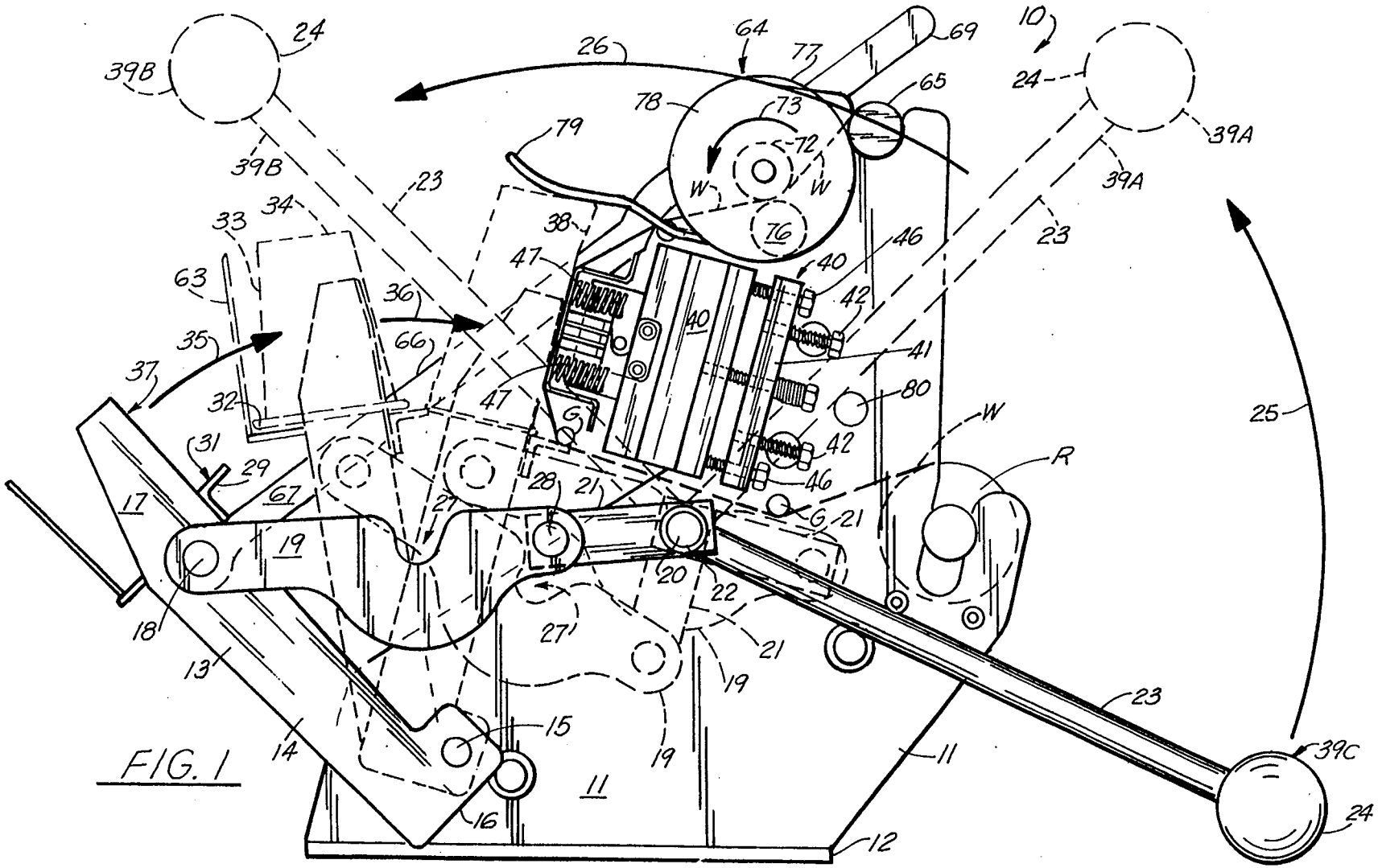
FIG. 1 is a side view of the preferred embodiment of the apparatus of the present invention.
Figure 2:
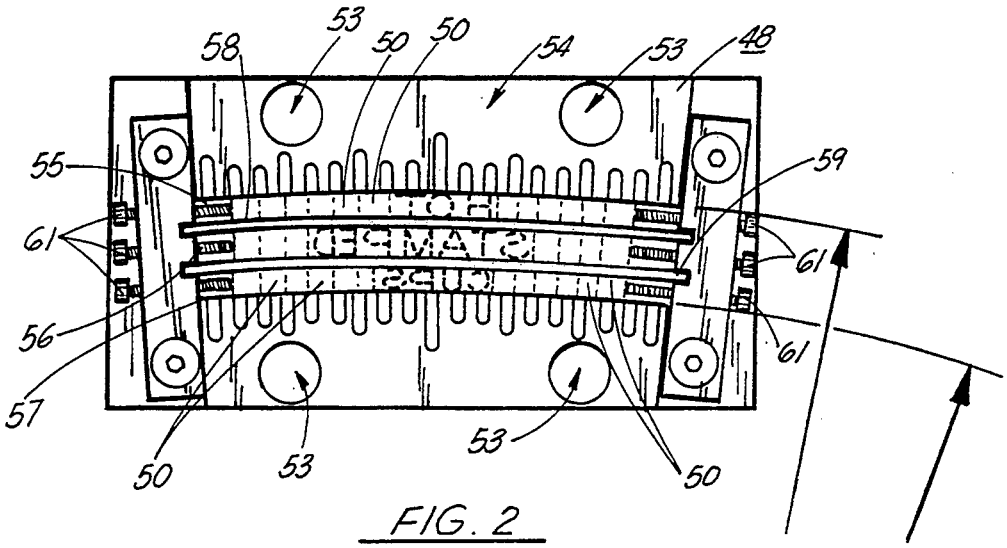
FIG. 2 is a fragmentary view illustrating the printing die portion of the preferred embodiment of the apparatus of the present invention.
Figure 3:
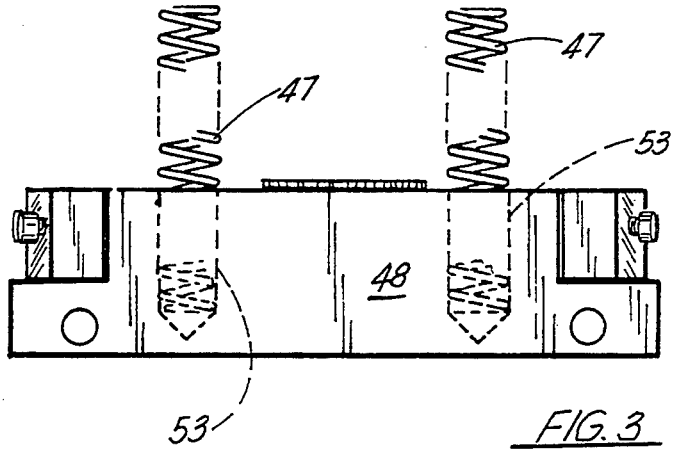
FIG. 3 is a side, fragmentary view illustrating the printing die portion of the preferred embodiment of the apparatus of the present invention.

FIGS. 1–5 illustrate the preferred embodiment of the apparatus of the present invention designated generally by the numeral 10 in FIG. 1. Hot stamping apparatus 10 includes a structural frame 11 having a lowermost base 12 that can be affixed (by bolting, for example) to an underlying support such as a table, for example. A roll R of foil unwinds to produce a web W of material that tracks guides G until the spent web W reaches a pinch roll assembly 64 and take-up roll 65.

Cup holder 13 includes an elongated arm 14 that is pivotally attached at pivot 15 to frame 11. The lower end of arm 14 is designated by the numeral 16. The upper end of arm 14 is designated by the numeral 17 and upper end portion 17 carries a thermoplastic, flexible article to be imprinted such as plastic cup 30, generally frustro-conical in shape.

First link 19 attaches at pinned connection 18 to arm 14. The opposite end portion of first link 19 forms a pinned connection 28 with second link 21. Second link 21 forms a rigid connection to shaft 22 which can be rotated at pinned connection 20 using lever 23.

A user can grasp handle 24 and move lever 23 upwardly and forwardly as shown by the curved arrows 25 and 26 in FIG. 1. This movement of handle 24 and its lever 23 similarly rotates second link 21 about pinned connection 20, downwardly and rearwardly as shown in phantom lines in FIG. 1. By rotating lever 23, shaft 22, and attached second link 21, the operator also moves pinned connection 28 and first link 19 to a first downwardly position and then to a rearward position as shown in phantom lines in FIG. 1.

First link 19 includes a recess portion 27 that is shaped to register upon and fit around shaft 22 when the first link 19 is moved to a rearward position. When the first link 19 contacts shaft 22, it acts as a stop to limit the forward travel of lever 23 from loading position 39A to printing position 39B. This rearward position is shown in phantom lines in FIG. 1 and is achieved when the lever 23 is moved with handle 24 to the position designated as 39B in FIG. 1. This position 39B of handle 24 and lever 23 designates the printing position. The loading position 39A is defined by a contact of lever 23 against stop pin 80. Pin 80 is retractable so that the lever 23 can travel to a die loading/foil changing position 39C.

As the lever 23 is moved to the printing position 39B, the first link 19 pulls arm 14 and cup 30 toward print head 40. Arm 14 has a split or forked flanged member 29 attached thereto at upper end 17, with spaced apart upper surfaces 31 (FIG. 7) that accommodate the rim 32 of inverted plastic cup 30. This places the cup 30 in a desired position upon arm 14, indexing the cup 30 in the desired position with respect to the printing head 40. Cup retainer 79 presses the cup 30 against cup stop 31 during printing. In this manner, a user can print a large number of cups 30 in sequential fashion and each cup will register in the exact position as the previous cup 30. This configuration of frame 11, arm 14, lever 23, first link 19, second link 21 and their connections defines a progressively increasing force means for increasing force applied to the printing head as the cup approaches the printing position. The combination of links 19, 21 and their connections defines an inverse toggle linkage.

Plastic cup 30 can include cup rim 32, cup side wall 33, and circular cup bottom 34. The cup rim 32 is of a larger circumference than the circumference of bottom 34 thus giving the cup an overall frustro-conical shape.

When the arm 14 moves forwardly from a loading position (shown in phantom lines as 39A in FIG. 1) to a printing position (designated as 39B in FIG. 1), arm 14 travels according to the path shown by curved arrow 36. Arm 14 above flanged member 29 presents a flat surface 37 of desired width (e.g. two-three inches) for deforming the cup 30 in a printed position. As shown in FIG. 1, the flat surface 37 presses cup 30 against the pressure foot 51 of printing head assembly 40 deforming the frustro-conical sidewall 33, flattening it. The foil web W is positioned between cup 30 and pressure foot 51. It should be understood that the flat surface 37 is of a desired size including length and width, to accommodate a desired printed matter (such as for example letters, words, phrases, artistic design, or a combination thereof).

Figure 5B:
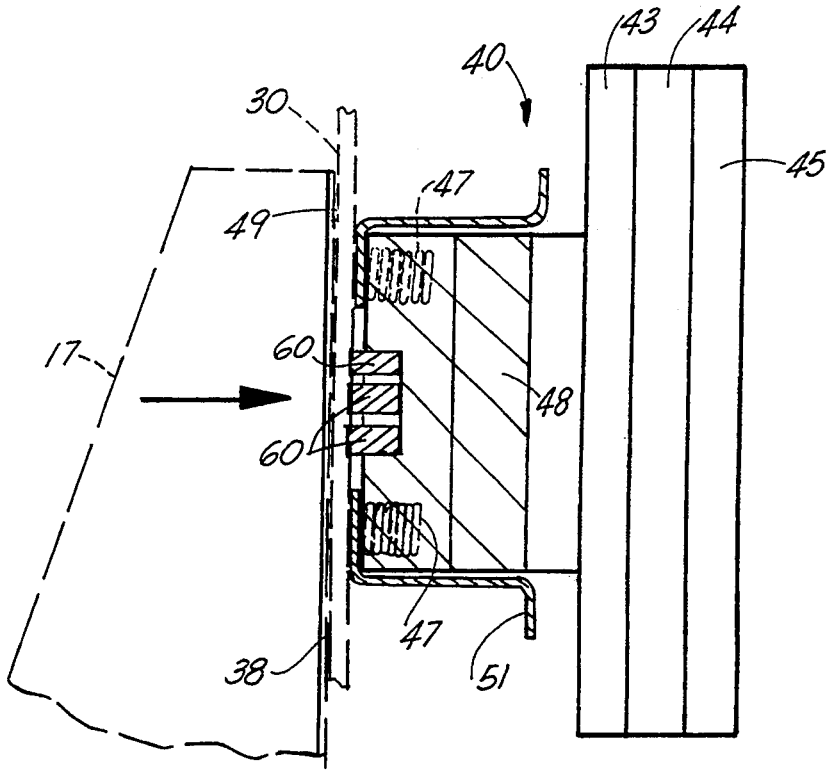
FIGS. 5A–5B are side fragmentary views of the preferred embodiment of the apparatus of the present invention taken along lines 5—5 of FIG. 4 and illustrating the printing die and pressure foot portions prior to (FIG. 5A) and during (FIG. 5B) the printing operation.
Figure 5A:
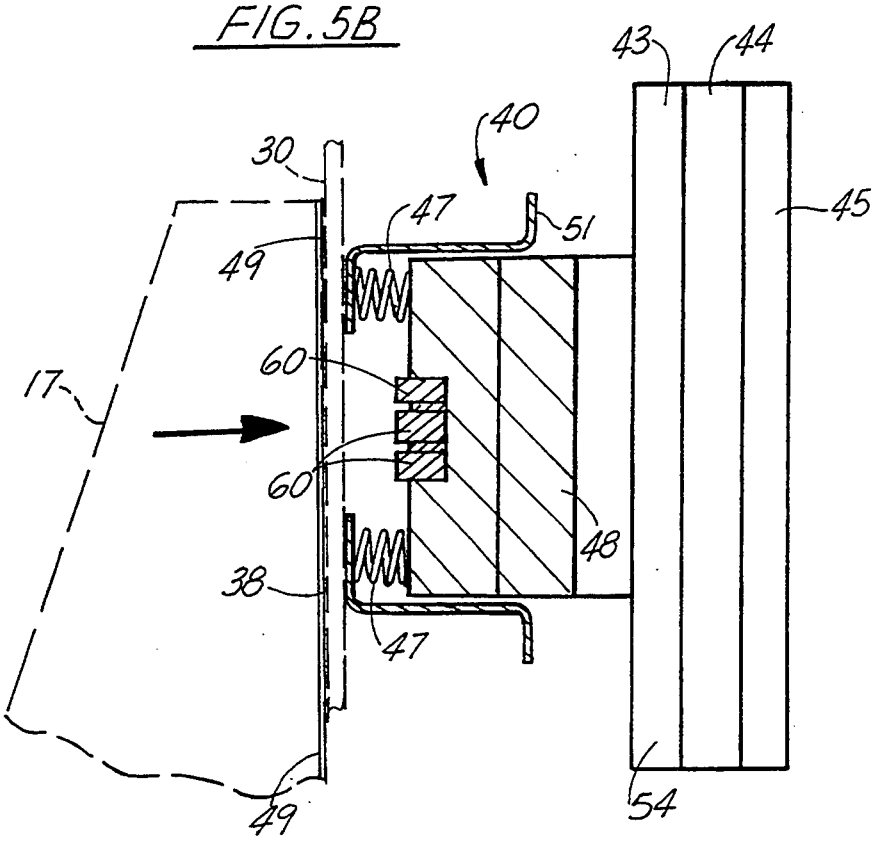

Printing head assembly 40 carries a hot block 43 with internal heating element FIG. 5A–5B which heats die 48 during printing. A web W of commercially available foil material is fed between the cup 30 and the printing head assembly 40 so that during the printing operation, a combination of pressure, time and heat transfers the foil material from the web to the plastic cup 30. It should be understood that hot stamping using a foil web material is per se known, hot stamping being commonly used to imprint articles such as business cards, books, and key chains and other articles. One supplier of hot stamping machines using a foil web material is Franklin Manufacturing. The foil material is commercially available from Kenson-Foilmark of New Jersey.

FIGS. 2–4 and 5A∝5B illustrate more particularly the construction of printing head assembly 40. Printing head assembly 40 is attached to frame 11 at removable connection in the form of mounting plate 41 which can be secured to frame 11 using for example, a bolted connection. The position of printing head assembly relative to frame 11 is adjustable. Adjusting screws 46 allow the printing head assembly to be moved toward or away from arm 14.

Printing head assembly 40 includes mounting plate 41, hot block 43, insulator member 44, base 45, springs 47, removable die element 48, and pressure foot 51. Die element 48 can be unbolted from hot block 43 for easy removal. Front face 54 of die element 48 has a plurality (e.g. three) of arcuate recesses 55–57 for holding type elements 50. Arcuate bands 58–59 separate rows 60 of type. Screws 61 (FIG. 2) or a combination of screws 61 and leaf springs 62 (FIG. 8) can be used to secure rows of type 60 tightly in position during use.

Figure 4:
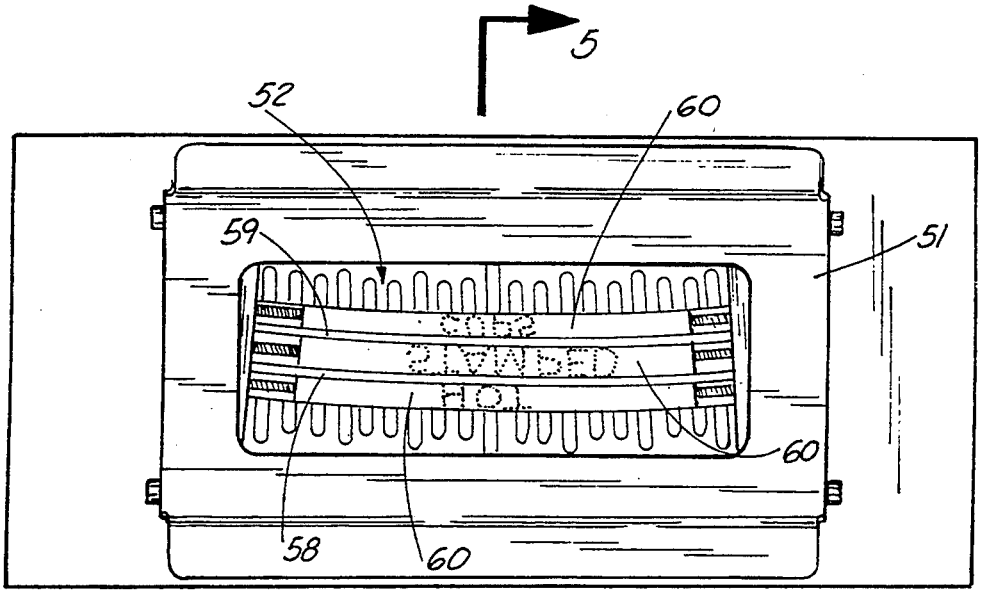
FIG. 4 is a front fragmentary view of the preferred embodiment of the apparatus of the present invention illustrating the printing die and pressure foot portions thereof.

A pressure plate 51 is positioned about and moves relative to die 48. Pressure plate 51 includes a generally rectangular opening 52 that extends around the type elements 50 as shown in FIG. 4. Springs 47 are interposed between die 48 and pressure foot 51. In use, the pressure foot 51 covered by foil web W first engages cup 30 wall 33. Spring tension of pressure plate 51 (supplied by coil springs 47) overcomes any resistance from the cup wall 33 and the cup wall is flattened against the flat surface 37 of arm 14 as shown in FIG. 1. The deformed cup wall 38 is shown in FIG. 1 during the printing position.

As lever 23 is moved to a fully forward printing position (designated as 39B in FIG. 1), the resilient material covered flat surface 37 of upper end 17 of arm 14 with cup 30 in position (FIG. 1), compresses the springs 47 as shown in FIG. 1 in hard lines. The type elements 50 then press against the deformed wall 38 of cup 30 with foil web in position between the type elements 50 and the deformed cup wall 38. The heating element is preferably always heated using a thermostat, so that the type elements 50 are hot when the type engages the foil web W. The combination of heat, pressure, and time transfers the foil from the web to the cup.

The apparatus thus disclosed provides a method of transferring foil from a web W to the cup when the cup is in a deformed flattened position. Further, by using an arcuate shape to the rows of type, any distortion due to cup wall shape is removed. The cup wall is typically frustro-conical in shape. However, during printing it is flattened. Therefore, by using the arcuate orientation of the letters, a correction is made so that when the cup returns to its original frustro-conical shape, the hot stamped lettering appears properly oriented to the eye of the observer.

The same type of arcuate correction would be included with any artistic design so that upon application of the hot stamped foil design to the cup, (i.e. in flattened position) the artistic design would appear properly proportioned and oriented after the cup is returned to its original frustro-conical shape.

A pointer 63 can be fitted to arm 14 as an alignment guide to assist the user. A reference point provided on each cup 30 would be aligned with the pointer 63 so that the type would strike cup 30 in the same place for each cup imprinted. Pinch roll assembly 64 pulls the web W of foil from roll R, across guides G to take up roll 65. During use, as lever 23 is moved between positions 39A and 39B, rod 66 also moves because it is pivotally attached at end 67 to first link 19. Arrow 74 in FIG. 6 shows the rotational movement of first link 19 that produces generally linear movement of rod 66 as shown by arrow 75.

Pin 68 rotates ratchet gear 70 each time lever 23 moves from printing position 39B back to loading position 39A and thus advancing web W. Rotation of gear 70 about shaft 71 also rotates drive roller 72 in the direction of arrow 73. Rotation of drive roller 72 also rotates idler roller 76 which engages drive roller 72 to pull and advance web W. Take up roll 65 fictionally engages drive roller 72 at periphery 77 of flange 78.

The following table lists the part numbers and part descriptions as used herein and in the drawings attached hereto.

TABLE I

PARTS LIST

| PART NUMBER | DESCRIPTION |
|---|---|
| 10 | apparatus |
| 11 | frame |
| 12 | base |
| 13 | cup holder |
| 14 | arm |
| 15 | pivot |
| 16 | lower end of arm |
| 17 | upper end of arm |
| 18 | pinned connection |
| 19 | first link |
| 20 | pinned connection |
| 21 | second link |
| 22 | shaft |
| 23 | lever |
| 24 | handle |
| 25 | curved arrow |
| 26 | curved arrow |
| 27 | recess |

TABLE I-continued

| PARTS LIST | |
|---|---|
| PART NUMBER | DESCRIPTION |
| 28 | pinned connection |
| 29 | flanged member |
| 30 | plastic cup |
| 31 | cup stop |
| 32 | cup rim |
| 33 | cup sidewall |
| 34 | cup bottom |
| 35 | curved arrow |
| 36 | curved arrow |
| 37 | flat surface |
| 38 | deformed portion cup |
| 39A | cup loading position |
| 39B | printing position |
| 39C | die and foil changing position |
| 40 | printing head assembly |
| 41 | mounting plate |
| 42 | mounting bolts |
| 43 | hot block |
| 44 | insulation member |
| 45 | base |
| 46 | adjusting screws |
| 47 | springs |
| 48 | die element |
| 49 | resilient material layer |
| 50 | type elements |
| 51 | pressure foot |
| 52 | rectangular opening |
| 53 | openings |
| 54 | front face of die |
| 55 | arcuate recess |
| 56 | arcuate recess |
| 57 | arcuate recess |
| 58 | arcuate band |
| 59 | arcuate band |
| 60 | row of type |
| 61 | screws |
| 62 | leaf springs |
| 63 | pointer |
| 64 | pinch roll assembly |
| 65 | take up roll |
| 66 | rod |
| 67 | end portion |
| 68 | pin |
| 69 | end portion |
| 70 | ratchet gear |
| 71 | center of rotation |
| 72 | drive roller |
| 73 | curved arrow |
| 74 | arrow |
| 75 | arrow |
| 76 | idler roller |
| 77 | periphery |
| 78 | flange |
| 79 | cup retainer |
| 80 | stop pin |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A hot stamping apparatus for imprinting plastic, frustro-conically shaped articles, comprising:

a) a frame;

b) a printing arm pivotally attached to the frame, the printing arm having a first end portion adjacent the frame and a second end portion distant from the frame;

c) indexing means at the second end portion of the arm for holding a frustro-conically shaped plastic article in a desired position relative to the frame;

d) a printing head assembly supported by the frame and in a position that engages the frustro-conically shaped plastic article in a defined printing position;

e) means for supporting a wound roll of hot stamping foil material that has a free end portion defining a web;

f) roller guide means for supporting the web upon the frame;

g) take up roll means for storing the free end of the web that has been spent;

h) ratchet means for advancing the web;

i) the printing head assembly further comprising removable type means for imprinting the frustro-conically shaped article with a desired printed representation; and j) heating means for transferring heat to the printing type, wherein the indexing means include means for deforming the plastic article so that a flat surface is presented to the printing head assembly.

2. The apparatus of claim 1 wherein the take up roll means rotates to store the free end of the web responsive to a movement of the arm.

3. The apparatus of claim 1 further comprising lever means for moving the arm during printing operations.

4. The apparatus of claim 1 wherein the printing arm moves between loading and printing positions.

5. The apparatus of claim 1 further comprising adjustment means for adjusting the position of the printing head with respect to the printing arm.

6. The apparatus of claim 1 further comprising resilient backing pad means positioned on the upper end portion of the arm for receiving at least a portion of the frustro-conically shaped article.

7. The apparatus of claim 1 further comprising pointer means for properly orienting the frustro-conically shaped plastic article in a desired rotational position with respect to the printing arm.

8. The apparatus of claim 1 wherein the printing head assembly is generally planar and comprises a block having a plurality of arcuate grooves formed in the block, each of the grooves being receptive of a plurality of individual generally rectangular type elements.

9. The apparatus of claim 1 further comprising means positioned at the end portions of the grooves for applying pressure to a plurality of type elements that are contained within the groove.

10. The apparatus of claim 1 wherein the indexing means comprises a pair of spaced apart supports positioned at the second end portion of the arm, and with a space therebetween so that the frustro-conically shaped article engages the indexing means at spaced apart positions on the frustro-conically shaped article.

11. A hot stamping apparatus for imprinting plastic, frustro-conically shaped articles with hot stamping foil material, comprising:

a) a frame;

b) a printing arm pivotally attached to the frame, the printing arm having a first end portion adjacent the frame and a second end portion distant from the frame;

c) indexing means at the second end portion of the arm for holding a frustro-conically shaped plastic article in a desired position relative to the frame;

d) a printing head assembly supported by the frame and in a position that engages the frustro-conically shaped plastic article in a defined printing position;

e) the printing head assembly further comprising removable type means for imprinting the frustroconically shaped article with a desired printed representation; and f) heating means for transferring heat to the printing type so that the foil and the article can be heated with the type, wherein the indexing means include means for deforming the plastic article so that a flat surface is presented to the printing head assembly.

12. The apparatus of claim 11 wherein the printing head assembly is generally planar and comprises a block having a plurality of arcuate grooves formed in the block, each of the grooves being receptive of a plurality of individual, generally rectangular type elements.

* * * * *